US009319797B2

(12) United States Patent
Huang

(10) Patent No.: US 9,319,797 B2
(45) Date of Patent: Apr. 19, 2016

(54) ELECTROMAGNETIC VIBRATION DEVICE AND MANUFACTURING METHOD THEREOF

(75) Inventor: Xinmin Huang, Ningbo (CN)

(73) Assignee: Tang Band Industries Co., Ltd., Ningbo, Zhejiang (CN)

( * ) Notice: Subject to any disclaimer, the term of this patent is extended or adjusted under 35 U.S.C. 154(b) by 0 days.

(21) Appl. No.: 14/389,377

(22) PCT Filed: Apr. 12, 2012

(86) PCT No.: PCT/CN2012/073870

§ 371 (c)(1),
(2), (4) Date: Sep. 30, 2014

(87) PCT Pub. No.: WO2013/143173

PCT Pub. Date: Oct. 3, 2013

(65) Prior Publication Data

US 2015/0063609 A1 Mar. 5, 2015

(30) Foreign Application Priority Data

Mar. 30, 2012 (CN) ..... 2012 1 0091531
Mar. 30, 2012 (CN) ..... 2012 2 0129454 U

(51) Int. Cl.

| | |
|---|---|
| ***H04R 9/06*** | (2006.01) |
| ***H04R 11/02*** | (2006.01) |
| ***H04R 31/00*** | (2006.01) |
| *H04R 1/00* | (2006.01) |

(52) U.S. Cl.

CPC ..... *H04R 11/02* (2013.01); *H04R 9/06* (2013.01); *H04R 31/00* (2013.01); *Y10T 29/49005* (2015.01)

(58) Field of Classification Search

CPC ..... H04R 7/18; H04R 7/20; H04R 9/02; H04R 9/025; H04R 9/06; H04R 9/043; H04R 9/063; H04R 2201/34; H04R 2307/207; H04R 2400/03; H04R 2400/11

USPC ..... 381/396, 398, 433

See application file for complete search history.

(56) References Cited

U.S. PATENT DOCUMENTS 8,175,319 B2 * 5/2012 Sumitani ..... H04R 9/025 381/397

FOREIGN PATENT DOCUMENTS

GB 2355616 A * 4/2001 ..... H04R 7/18

* cited by examiner

*Primary Examiner* — Brian Ensey

(74) *Attorney, Agent, or Firm* — Raymond Y. Chan; David and Raymond Patent Firm

(57) ABSTRACT

An electromagnetic vibration device includes a vibration plate device, a voice coil assembly, a magnetic loop system, and a peripheral basin frame. One end of the peripheral basin frame is coupled to the vibration plate device, and the other end thereof is coupled to the magnetic lop system. The peripheral basin frame includes a plurality of connecting frames, wherein every two connecting frames are connected by a connecting member to form an integral peripheral basin frame. The size of the peripheral basin frame is adjusted by the distance between the connection frames or relative increase of the number of the connection frames, so that the size of the peripheral basin frame is adjustable to match with the vibration plate device of the electromagnetic vibration device. Only a mold is required to manufacture the connecting frame to form the peripheral basin frame for different sizes of electromagnetic vibration device.

18 Claims, 4 Drawing Sheets

ELECTROMAGNETIC VIBRATION DEVICE AND MANUFACTURING METHOD THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to an electromagnetic vibration device, and more particularly to an electromagnetic vibration device, wherein a peripheral basin frame is constructed by a plurality of connection frames being connected with each other via a plurality connection members, so as to selectively adjust the diameter size of the peripheral basin frame corresponding to the size of electromagnetic vibration device. Therefore, only one single mold is required for manufacturing the connection frame to form the peripheral basin frame for the electromagnetic vibration device.

2. Description of Related Arts

Electromagnetic vibration device, such as a speaker, is a device which can transform electrical energy to sound energy. Currently, there are different speakers that incorporate with different structural configurations. Ultimately, they generate mechanical vibration to vibrate the air to generate sound waves so as to achieve an electrical-to-sound energy transformation. In particular, a manufacturing method for a conventional electromagnetic vibration device generally comprises the steps of attaching T-shaped magnetic element or U-shaped magnetic element to a lower basin frame with a magnet therein to form a magnetic loop system; coupling a terminal, a vibration layer, a voice coil, and a suspension to the lower basin frame in order to generate a reciprocatingly movement of the vibration layer in response to a magnetically induction of the voice coil the magnet; and affixing an upper basin frame to the lower basin frame to retain all the components of the speakers between the upper and lower basin frames. In other words, the diameter size of the upper basin frame must match with the diameter size of the speaker.

With the advent of high technology, living standard for people is rapidly increasing. In other words, the user looks for a speaker not only for sound generation but also generating good sound quality. It is known that a bass speaker requires a larger resonant chamber, such that a bigger size of the speaker must be manufactured to enhance the sound quality in low frequency Therefore, some large manufacturers have introduced a 14-inch speaker, 16-inch, and 18-inch large-caliber speakers to satisfy customer's needs.

Due to different sizes of the speakers, the manufacturers must make different sizes of upper basin frames to match with the size of the speakers. In particular, each size of the upper basin frame requires one particular mold. In other words, if the manufacturers need to manufacture different sizes of upper basin frames, different molds must be pre-made, which will substantially increase the manufacturing cost of the speaker. In addition, the manufacturers will use more amount of raw material to manufacture the larger size upper basin frame and the overall weight thereof will be increased. The equipment for manufacturing the larger size upper basin frame is expensive than that for manufacture the smaller size upper basin frame. Meanwhile, each mold can only make one particular size of upper basin frame.

Furthermore, when the voice coil is energized to vibrate after a predetermined time, the voice coil and magnetic loop will generate a lot amount of heat. Therefore, if the heat dissipating ability of the speaker is not good enough, it will affect the sound quality of the speaker, and even burn the speaker. Currently, the upper basin frame for the speaker is made of plastic or aluminum. The plastic made upper basin frame does not have enough heat conduction ability, such that the cooling effect thereof is not good enough. At the same time, the upper basin fame also retains the magnetic loop system in position. During the operation of the magnetic loop system, the vibration layer and the voice coil are reciprocatingly moved. In other words, the vibration force will exert to the upper basin frame. Therefore, the plastic made upper basin frame does not provide enough rigidity to retain the reciprocatingly movements of the vibration layer and the voice coil. On the other hand, even though the aluminum made upper basin frame has better heat dissipating ability, the cost of the aluminum made upper basin frame is relatively expensive.

SUMMARY OF THE PRESENT INVENTION

A main object of the present invention is to provide an electromagnetic vibration device, which comprises a vibration plate device, a voice coil assembly, a magnetic loop system, and a peripheral basin frame, wherein the vibration plate device is securely coupled with the magnetic loop system via the peripheral basin frame to form the electromagnetic vibration device. The peripheral basin frame comprises a plurality of connection frames and a plurality of connection members, wherein the connection frames are coupled with each other via the connection members to form an encircling frame, such that the distance between each two connection frames can be selectively adjusted to adjust a diameter size of the encircling frame corresponding to a diameter size of the vibration plate device. Once the diameter size of the encircling frame is configured, the connection frames can be securely coupled with each other via the connection members to retain the diameter size of the encircling frame. As a result, the peripheral basin frame can be selectively configured to fit different sizes of the electromagnetic vibration device.

Another object of the present invention is to provide a manufacturing method of the electromagnetic vibration device, wherein only one single mold is required for manufacturing the connection frame, (such as manufacturing ¼ of the peripheral basin frame) to fit different sizes of the electromagnetic vibration device, so as to reduce the manufacturing cost and to material cost of the electromagnetic vibration device.

Another object of the present invention is to provide an electromagnetic vibration device, wherein the connection frame is made of aluminum (which also can be other metals with good heat dissipation ability), and the connection member is made of plastic by plastic injection method (other materials are available for replace the plastic), so that the heat generated from the voice coil assembly and the magnetic loop system can effectively dissipate through the connection frame to enhance the heat dissipation of the electromagnetic vibration device.

Another object of the present invention is to provide an electromagnetic vibration device, wherein in case of the malfunction of the electromagnetic vibration device, the connection frame can be re-used for a new electromagnetic vibration device, such that the peripheral basin frame is an environmental friendly product.

In order to achieve the above objects, the present invention provides an electromagnetic vibration device, which comprises a vibration plate device, a voice coil assembly, a magnetic loop system, and a peripheral basin frame.

The vibration plate device comprises a base having a ring shape, a vibration plate, an upper suspension, and a lower suspension, wherein the base has an inner peripheral surface at an inner surrounding wall of the base to define a vibration plate chamber therewithin. The vibration plate is supported within the vibration plate chamber of the base Inner edges of the upper suspension and the lower suspension are attached on a top surface and a bottom surface of the vibration plate, preferably by adhesive, respectively, wherein outer edges of the upper suspension and the lower suspension are attached on a top surface and a bottom surface of the base, preferably by adhesive, respectively.

One end of the voice coil assembly is coupled at the bottom surface of the vibration plate at the center portion thereof, wherein two cables are extended from the voice coil assembly.

The magnetic loop system comprises a pole member which is a pole piece, a magnetic member having a T-shaped cross section and made by metal, and a magnet. The magnet and the pole member are coupled on the magnetic member respectively that the pole member is on top of the magnetic member.

Two ends of the peripheral basin frame are coupled to the vibration plate device and the magnetic loop system respectively, wherein the vibration plate device is coupled at the upper end of the peripheral basin frame while the magnetic loop system is coupled at the lower end of the peripheral basin frame to form the electromagnetic vibration device. The peripheral basin frame comprises a plurality of connection frames, a plurality of connection members, and a connection base. Accordingly, one end of each of the connection frames is coupled to the vibration plate device, and the other end of each of the connection frames is coupled to the connection base. In addition, the connection frames are coupled with each other via the connection members. In other words, each connection member couples with two ends of two adjacent connection frames in order to connect the connection frames with each other end-to-end to form an encircling frame. Therefore, the encircling frame configured by the connection frames is coupled on the connection base, so as to form the integrated structure of the peripheral basin frame. Moreover, the connection base has a center through slot, a connection hole, and an outwardly extended retention wing, wherein when the magnetic loop system is coupled to the connection base, the connection hole is aligned with the first positioning hole of the pole member, such that the magnetic loop system can be secured to the connection base of the peripheral basin frame by affixing at least a screw through the connection hole and the first positioning hole.

Accordingly, the connection frame further has a first connection portion and a second connection portion. The first connection portion is downwardly extended from the bottom surface of the connection frame to couple at the retention wing of the connection base. The second connection portion is upwardly extended from the upper surface of the connection frame to retain the electromagnetic vibration device in position.

Moreover, the connection frame further has at least one through hole formed at the first connection portion to couple at the retention wing of the connection base via a screw.

In particular, the connection frame further comprises a supporting rim integrally and outwardly projected from an inner surface of the connection frame at the upper portion thereof, wherein the supporting rim has an arc configuration matching with a curvature of the outer peripheral edge of the base of the vibration plate device. Therefore, when the connection frames are coupled with each other, the supporting rims are radially and spacedly aligned to form a plurality of rim support segments secured at the outer peripheral edge of the base of the vibration plate device.

Furthermore, the connection frame further has at least a second positioning hole formed at the supporting rim, wherein the vibration plate device is secured at the supporting rim by affixing a screw through the second positioning hole.

In particular, the inner surface of the connection frame is engaged with the outer peripheral edge of the base of the vibration plate device, preferably by adhesive, while the upper surface of the supporting rim is engaged with the bottom surface of the base of the vibration plate device, preferably by adhesive, so as to securely couple and seal the base of the vibration plate device at the connection frame.

Alternatively, the base of the vibration plate device can be engaged with the supporting part of the connection frame via any fastening structure such as clip-on engagement.

Furthermore, the connection frame further has at least two connection holes formed at two ends of the second connection portion respectively, wherein the connection member is securely coupled at two second connection portions of two connection frames by the screws through the connection holes, so as to connect the two connection frames with each other.

Moreover, the connection frame is made of a metal material with good thermal conductivity.

Preferably, the connection frame is made of aluminum.

Accordingly, the connection frame has at least one metal terminal to electrically connect to the cables of the voice coil assembly.

Moreover, the outer surface of the connection frame has a plurality of spaced apart projected ribs to enhance the rigidity of the connection frame, wherein a heat dissipating slot is formed within each two adjacent projected ribs so as to enhance heat dissipating surface of the connection frame.

It is worth mentioning that during the operation of the electromagnetic vibration device, the voice coil assembly and the magnetic loop system are magnetically inducted to generate a huge amount of the heat, so that the heat can be dissipated from the connection frame to the surroundings.

It is worth mentioning that for a large-sized electromagnetic vibration device having a larger diameter, a larger diameter size of the peripheral basin frame must be used. The diameter size of the peripheral basin frame can be selectively adjusted via the connection frames and the connection members. In other words, a distance between two adjacent connection frames can be selectively adjusted via the connection member, wherein the connection member is coupled between the two adjacent connection frames to retain the predetermined distance therebetween. When the distance between two adjacent connection frames is increased, the diameter size of the peripheral basin frame will be increased. Likewise, by increasing the numbers of the connection frames, the diameter size of the peripheral basin frame will also be increased. Therefore, the diameter size of the peripheral basin frame can be selectively adjusted to match with the diameter size of the vibration plate device. Once the connection frames are configured to form the encircling frame that matches with the vibration plate device, the connection members are coupled to the connection frames to retain the diameter size of the encircling frame so as to form the peripheral basin frame around the vibration plate device.

A manufacturing method of the electromagnetic vibration device comprises the following steps.

(a) Provide a first mold for the connection frame, wherein the connection frame is formed by die casting or stamping process.

(b) Provide a second mold for the connection member, wherein the connection member is made by plastic mold injection.

(c) Connect the connection frames, for example four connecting frames, via the connection members to form the encircling frame as an upper peripheral basin frame (which can also form an integral peripheral basin frame).

(d) Connect the encircling frame with the connection base via the screw fastening at the through hole to form the peripheral basin frame.

(e) Dispose the upper suspension and the vibration plate in a base mold, wherein the base is formed by plastic mold injection to integrally connect with the upper suspension between the vibration plate and the base so as to form a vibration unit.

(f) Couple an inner edge of the lower suspension at the bottom surface of the vibration plate of the vibration unit, preferably by adhesive, and couple an outer edge of the lower suspension at the bottom surface of the base to couple the lower suspension between the vibration plate and the base so as to form the vibration plate device.

It is worth mentioning that two vibration units can be coupled with each other to form the vibration plate device, wherein one of the vibration units is flipped 180 degrees, i.e. up-side-down, to couple with another vibration unit. In other words, two vibration plates are overlapped with each other while one of the upper suspensions is flipped to serve as the lower suspension. Accordingly, the two vibration units can be fastened by adhesive or any fastening structure.

(g) Dispose the magnetic member, the magnet, and the pole member in a third mold, wherein a lower basin frame is formed by plastic mold injection to connect the magnetic member, the magnet, and the pole member with each other. In other words, the magnetic loop system is built-in with the lower basin frame.

(h) Couple the voice coil assembly at the vibration plate via a supportive plate.

(i) Couple the vibration plate device at the lower basin frame to operatively couple the voice coil assembly with the magnetic loop system through the peripheral basin frame via screws, heat-welding, and fastener, such that the integrated electromagnetic vibration device, such as a speaker or a bass speaker with larger diameter, is formed.

The advantage of the present invention is that the vibration plate device is securely coupled with the magnetic loop system via the peripheral basin frame to form the electromagnetic vibration device. The peripheral basin frame comprises a plurality of connection frames and a plurality of connection members, wherein the connection frames are coupled with each other via the connection members to form an encircling frame, such that the distance between each two connection frames can be selectively adjusted to adjust a diameter size of the encircling frame corresponding to a diameter size of the vibration plate device. Once the diameter size of the encircling frame is configured, the connection frames can be securely coupled with each other via the connection members to retain the diameter size of the encircling frame. As a result, the peripheral basin frame can be selectively configured to fit different sizes of the electromagnetic vibration device. In addition, only one single mold is required for manufacturing the connection frame to fit different sizes of the electromagnetic vibration device, so as to reduce the manufacturing cost and to material cost of the electromagnetic vibration device. Furthermore, the connection frame is made of high heat dissipation material, so that the heat generated from the voice coil assembly and the magnetic loop system can effectively dissipate through the connection frame to enhance the heat dissipation of the electromagnetic vibration device.

DETAILED DESCRIPTION OF THE PREFERRED EMBODIMENT

Figure 1:
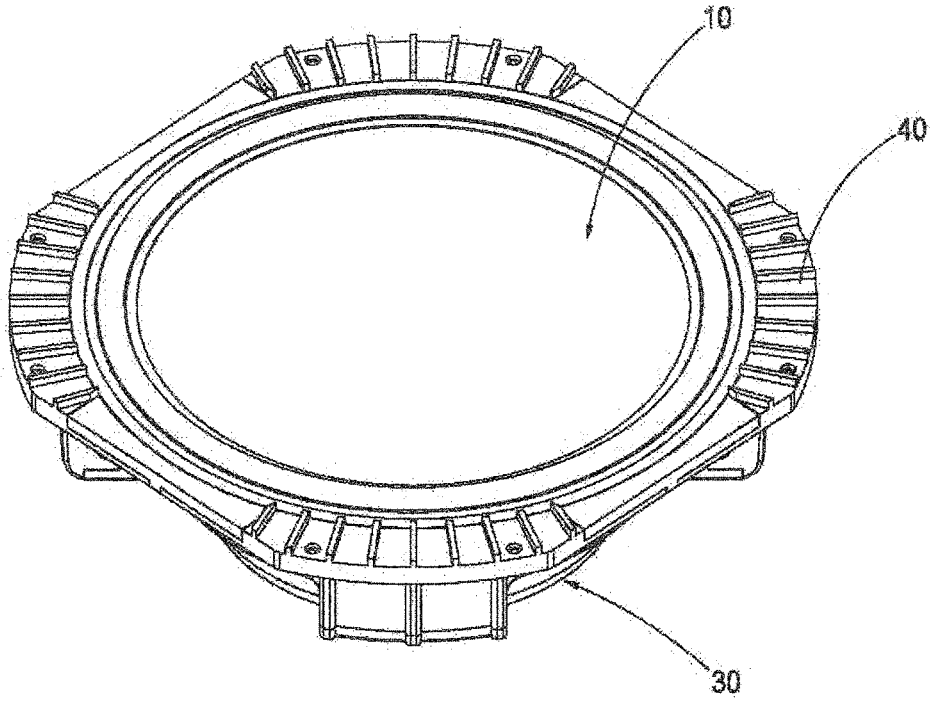
FIG. 1 is a perspective view of the electromagnetic vibration device according to a preferred embodiment of the present invention.

Referring to FIGS. 1 to 4 of the drawings, an electromagnetic vibration device according to a preferred embodiment of the present invention is illustrated, wherein the electromagnetic vibration device comprises a vibration plate device 10, a voice coil assembly 20, a magnetic loop system 30, and a peripheral basin frame 40.

The vibration plate device 10 comprises a base 11 having a ring shape, a vibration plate 12, an upper suspension 13, and a lower suspension 14, wherein the base 11 has an inner peripheral surface at an inner surrounding wall of the base 11 to define a vibration plate chamber 111 therewithin. The vibration plate 12 is supported within the vibration plate chamber 111 of the base 11. Timer edges of the upper suspension 13 and the lower suspension 14 are attached on a top surface and a bottom surface of the vibration plate 12, preferably by adhesive, respectively, wherein outer edges of the upper suspension 13 and the lower suspension 14 are attached on a top surface and a bottom surface of the base 11, preferably by adhesive, respectively.

One end of the voice coil assembly 20 is coupled at the bottom surface of the vibration plate 12 at the center portion thereof, wherein two cables 21 are extended from the voice coil assembly 20.

The magnetic loop system 30 comprises a pole member 31 which is a pole piece, a magnetic member 32 having a T-shaped cross section and made by metal, and a magnet 33, wherein at least one first positioning hole 311 is formed at the pole member 31. When two or more of first positioning holes 311 are configured, the first positioning holes 311 are radially positioned on the pole member 31. The magnet 33 and the pole member 31 are coupled on the magnetic member 32 respectively that the pole member 31 is on top of the magnetic member 32.

Figure 2:
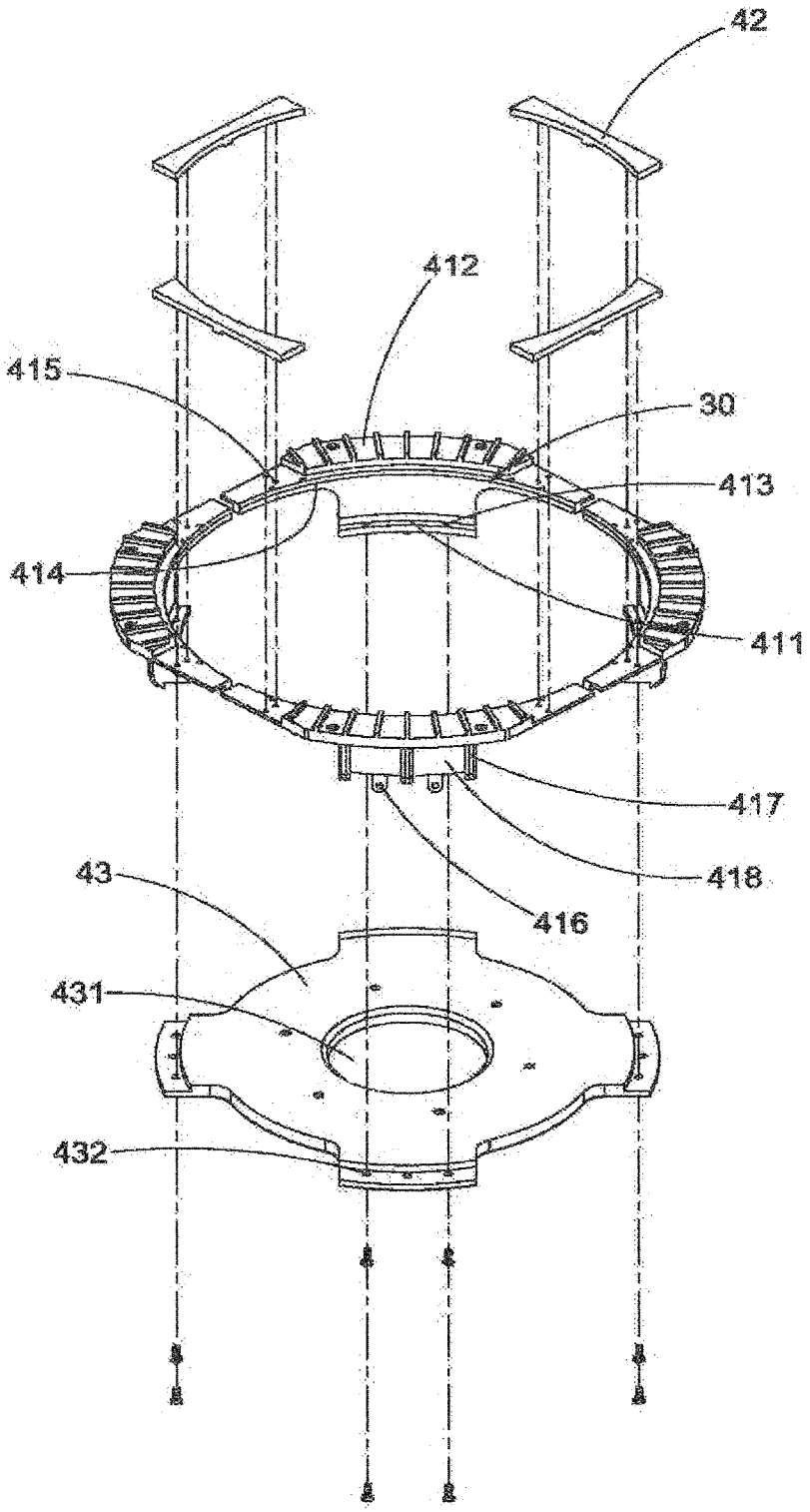
FIG. 2 is an exploded view of a peripheral basing frame of the electromagnetic vibration device according to the above preferred embodiment of the present invention.
Figure 3:
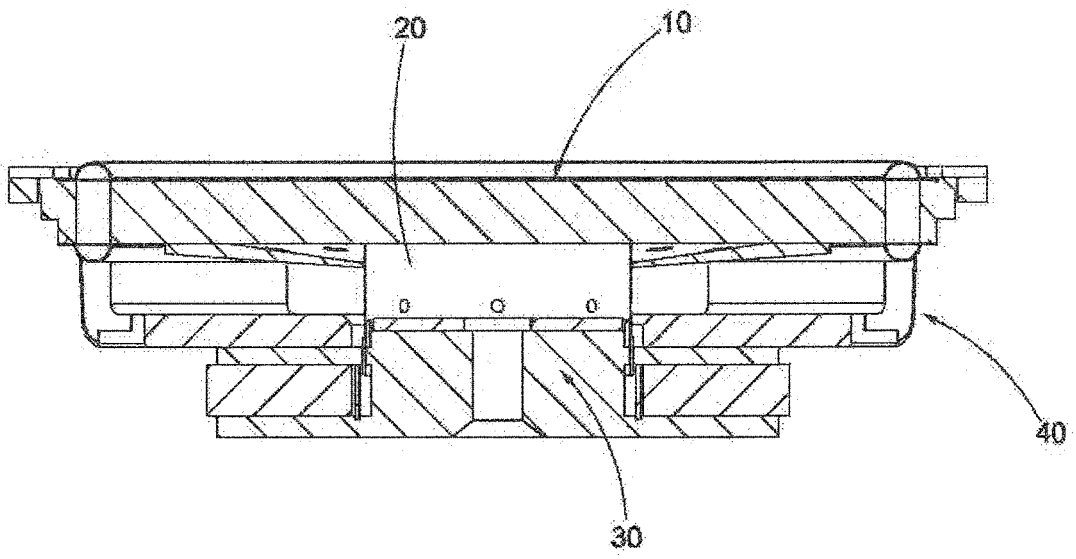
FIG. 3 is a sectional view of the electromagnetic vibration device according to the above preferred embodiment of the present invention.
Figure 4:
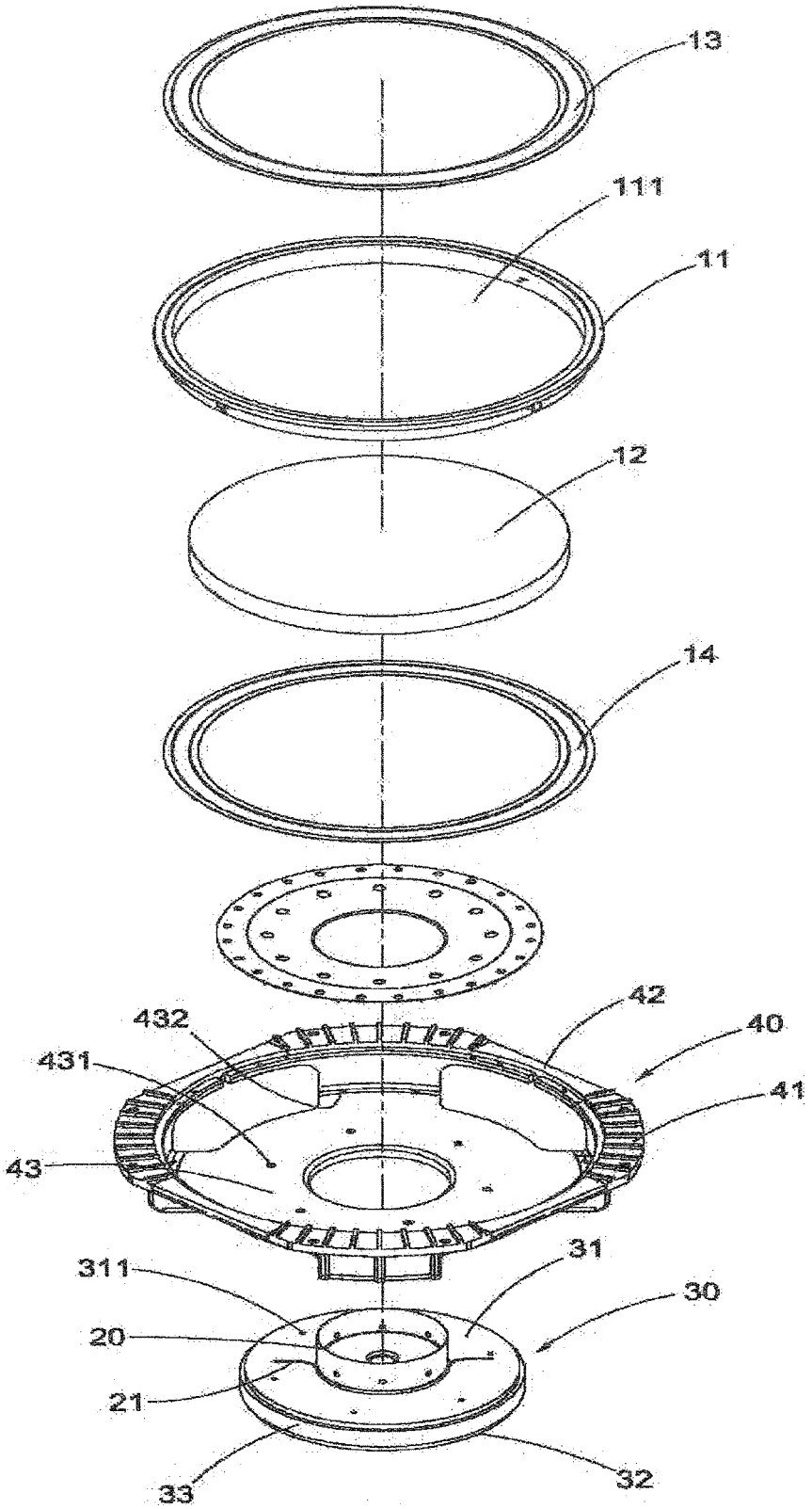
FIG. 4 is an exploded view of the electromagnetic vibration device according to the above preferred embodiment of the present invention.

As shown in FIG. 2, two ends of the peripheral basin frame 40 are coupled to the vibration plate device 10 and the magnetic loop system 30 respectively, wherein the vibration plate device 10 is coupled at the upper end of the peripheral basin frame 40 while the magnetic loop system 30 is coupled at the lower end of the peripheral basin frame 40 to form the electromagnetic vibration device. The peripheral basin frame 40 comprises a plurality of connection frames 41, a plurality of connection members 42, and a connection base 43. Accordingly, one end of each of the connection frames 41 is coupled to the vibration plate device 10, and the other end of each of the connection frames 41 is coupled to the connection base 43. In addition, the connection frames 41 are coupled with each other via the connection members 42. In other words, each connection member 42 couples with two ends of two adjacent connection frames 41 in order to connect the connection frames 41 with each other end-to-end to form an encircling frame. Therefore, the encircling frame configured by the connection frames 41 is coupled on the connection base 43, so as to form the integrated structure of the peripheral basin frame 40. Moreover, the connection base 43 has a center through slot, a connection hole 431, and an outwardly extended retention wing 432, wherein when the magnetic loop system 30 is coupled to the connection base 43, the connection hole 431 is aligned with the first positioning hole 311 of the pole member 31, such that the magnetic loop system 30 can be secured to the connection base 43 of the peripheral basin frame 40 by affixing at least a screw through the connection hole 431 and the first positioning hole 311.

Accordingly, the connection frame 41 further has a first connection portion 411 and a second connection portion 412. The first connection portion 411 is downwardly extended from the bottom surface of the connection frame 41 to couple at the retention wing 432 of the connection base 43. The second connection portion 412 is upwardly extended from the upper surface of the connection frame 41 to retain the electromagnetic vibration device in position.

Moreover, the connection frame 41 further has at least one through hole 413 formed at the first connection portion 411 to couple at the retention wing 432 of the connection base 43 via a screw.

In particular, the connection frame 41 further comprises a supporting rim 414 integrally and outwardly projected from an inner surface of the connection frame 41 at the upper portion thereof, wherein the supporting rim 414 has an arc configuration matching with a curvature of the outer peripheral edge of the base 11 of the vibration plate device 10. Therefore, when the connection frames 41 are coupled with each other, the supporting rims 414 are radially and spacedly aligned to form a plurality of rim support segments secured at the outer peripheral edge of the base 11 of the vibration plate device 10.

Furthermore, the connection frame 41 further has at least a second positioning hole 415 formed at the supporting rim 414, wherein the vibration plate device 10 is secured at the supporting rim 414 by affixing a screw through the second positioning hole 415.

In particular, the inner surface of the connection frame 41 is engaged with the outer peripheral edge of the base 11 of the vibration plate device 10, preferably by adhesive, while the upper surface of the supporting rim 414 is engaged with the bottom surface of the base 11 of the vibration plate device 10, preferably by adhesive, so as to securely couple and seal the base 11 of the vibration plate device 10 at the connection frame 41.

Alternatively, the base 11 of the vibration plate device 10 can be engaged with the supporting part 414 of the connection frame 41 via any fastening structure such as clip-on engagement.

Furthermore, the connection frame 41 further has at least two connection holes 415 formed at two ends of the second connection portion 412 respectively, wherein the connection member 42 is securely coupled at two second connection portions 412 of two connection frames 41 by the screws through the connection holes 415, so as to connect the two connection frames 41 with each other.

Moreover, the connection frame 41 is made of a metal material with good thermal conductivity.

Preferably, the connection frame 41 is made of aluminum.

Accordingly, the connection frame 41 has at least one metal terminal 416 to electrically connect to the cables 21 of the voice coil assembly 20.

Moreover, the outer surface of the connection frame 41 has a plurality of spaced apart projected ribs 417 to enhance the rigidity of the connection frame 41, wherein a heat dissipating slot 418 is formed within each two adjacent projected ribs 417 so as to enhance heat dissipating surface of the connection frame 41.

It is worth mentioning that during the operation of the electromagnetic vibration device, the voice coil assembly 20 and the magnetic loop system 30 are magnetically inducted to generate a huge amount of the heat, so that the heat can be dissipated from the connection frame 41 to the surroundings.

It is worth mentioning that for a large-sized electromagnetic vibration device having a larger diameter, a larger diameter size of the peripheral basin frame 40 must be used. The diameter size of the peripheral basin frame 40 can be selectively adjusted via the connection frames 41 and the connection members 42. In other words, a distance between two adjacent connection frames 41 can be selectively adjusted via the connection member 42, wherein the connection member 42 is coupled between the two adjacent connection frames 41 to retain the predetermined distance therebetween. When the distance between two adjacent connection frames 41 is increased, the diameter size of the peripheral basin frame 40 will be increased. Likewise, by increasing the numbers of the connection frames 41, the diameter size of the peripheral basin frame 40 will also be increased. Therefore, the diameter size of the peripheral basin frame 40 can be selectively adjusted to match with the diameter size of the vibration plate device 10. Once the connection frames 41 are configured to form the encircling frame that matches with the vibration plate device 10, the connection members 42 are coupled to the connection frames 41 to retain the diameter size of the encircling frame so as to form the peripheral basin frame 40 around the vibration plate device 10.

A manufacturing method of the electromagnetic vibration device comprises the following steps.

(a) Provide a first mold for the connection frame 41, wherein the connection frame 41 is formed by die casting or stamping process.

(b) Provide a second mold for the connection member 42, wherein the connection member 42 is made by plastic mold injection.

(c) Connect the connection frames 41, for example four connecting frames, via the connection members 42 to form the encircling frame as an upper peripheral basin frame (which can also form an integral peripheral basin frame).

(d) Connect the encircling frame with the connection base 43 via the screw fastening at the through hole 413 to form the peripheral basin frame 40.

(e) Dispose the upper suspension 13 and the vibration plate 12 in a base mold, wherein the base 11 is formed by plastic mold injection to integrally connect with the upper suspension 13 between the vibration plate 12 and the base 11 to form a vibration unit.

(f) Couple the inner edge of the lower suspension 14 at the bottom surface of the vibration plate of the vibration unit, preferably by adhesive, and couple the outer edge of the lower suspension 14 at the bottom surface of the base 11 to connect the lower suspension 14 between the vibration plate 12 and the base 11 so as to form the vibration plate device 10.

It is worth mentioning that two vibration units can be coupled with each other to form the vibration plate device 10, wherein one of the vibration units is flipped 180 degrees, i.e. up-side-down, to couple with another vibration unit. In other words, two vibration plates 12 are overlapped with each other while one of the upper suspensions 13 is flipped to serve as the lower suspension 14. Accordingly, the two vibration units can be fastened by adhesive or any fastening structure.

(g) Dispose the magnetic member 32, the magnet 33, and the pole member 31 in a third mold, wherein a lower basin frame is formed by plastic mold injection to connect the magnetic member 32, the magnet 33, and the pole member 31 with each other. In other words, the magnetic loop system 30 is built-in with the lower basin frame.

(h) Couple the voice coil assembly 20 at the vibration plate 12 via a supportive plate.

(i) Couple the vibration plate device 10 at the lower basin frame to operatively couple the voice coil assembly 20 with the magnetic loop system 30 through the peripheral basin frame 40 via one of screws, heat-welding, and fastener, such that the integrated electromagnetic vibration device, such as a speaker or a bass speaker with larger diameter, is formed.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An electromagnetic vibration device, comprising, a vibration plate device having a base, a vibration plate, a upper suspension, a lower suspension, wherein said base has an inner side surface surrounding around said base to form a vibration plate chamber, wherein said vibration plate is arranged within said vibration plate chamber, wherein inner edges of said upper and said lower suspension are fixedly adhered with a upper and a lower surface of said vibration plate respectively, wherein outer edges of said upper and said lower suspension are fixedly adhered with an upper and a lower surface of said base respectively, a voice coil fixed arranged on a center position of a bottom surface of said vibration plate having two cables;

a magnetic loop system comprising a pole piece, a T-yoke, and a magnet, wherein at least one first fixing holes are spacedly located around said pole piece, and said magnet and said pole piece are fixedly arranged on said T-yoke, and a peripheral basin frame are connected with said vibration plate device and said magnetic loop system respectively for forming said electromagnetic vibration device, wherein said peripheral basin frame has at least one connection frames, at least one connection blocks and a connection base, wherein one end of said connection frame is connected to said vibration plate device, and the other end of said connection frame is fixed connected to the connection base, and each two adjacent said connection frames are connected together by a connection block, and said connection base is fixedly connected to one end of said connection frame, so as to form said integral peripheral basin frame.

2. The electromagnetic vibration device, as recited in claim 1, wherein peripheral basin frame comprises connection holes and a fixing frame arranged thereon, wherein said connection holes of said peripheral basin frame are screwed to connect with said first fixing holes of said pole piece of said magnetic loop system so as to fixedly connect said peripheral basin frame and said magnetic loop system together.

3. The electromagnetic vibration device, as recited in claim 2, wherein said connection frame has a first connection end and a second connection end, wherein said first connection end is provided at the bottom end of said connection frame and fixedly connected to said fixing frame of said connection base; and the second connection end is provided at the top end of said connection frame for fixing the entire electromagnetic vibration device.

4. The electromagnetic vibration device, as recited in claim 3, wherein said first connection end of the connection frame has at least one through holes so as to fixedly screw said connection frame on said fixing frame of said connection base.

5. The electromagnetic vibration device, as recited in claim 1, wherein said connection frame comprises a inner surface located on the top end of said connection frame and outwardly projected to from a supporting part, wherein two ends of said supporting parts are integrally and outwardly extended to the adjacent said connection frame respectively to from a radian, which is corresponding to an outer surface radian of said base of said vibration plate device, so as to fixedly install said vibration plate device.

6. Then electromagnetic vibration device, as recited in claim 5, wherein said supporting part of said connection frame has at least one second fixing holes, wherein said vibration plate device and said supporting part of said connection frame are fixedly connected by screws.

7. The electromagnetic vibration device, as recited in claim 1, wherein an inner surface of said connection frame is fixedly connected to an outer surface of said base of said vibration plate device by glue.

8. The electromagnetic vibration device, as recited in claim 5, wherein an upper surface of said supporting part is fixedly connected to a bottom part of said base of said vibration plate device by glue.

9. The electromagnetic vibration device, as recited in claim 5, wherein said supporting part of said connection frame is locked with said base of said vibration plate device.

10. The electromagnetic vibration device, as recited in claim 3, wherein two ends of said second connection end of said connection frame has at least one connection holes, such that said two adjacent connection frames can be screwed to connect with said connection block via said connection holes.

11. The electromagnetic vibration device, as recited in claim 1, wherein said connection frame is made of a metal material with good thermal conductivity.

12. The electromagnetic vibration device, as recited in claim 1, wherein said connection frame is made of aluminum.

13. The electromagnetic vibration device, as recited in claim 1, wherein said connection frame has at least one metal terminal electrically connected to said cables of said voice coil.

14. The electromagnetic vibration device, as recited in claim 1, wherein an outer surface of said connection frame has a plurality of projected strips to improve the hardness of said connection frame 41, wherein a heat dissipating slot is formed within each said two projected strips so as to improve heat dissipating surface of said connection frame.

15. The electromagnetic vibration device, as recited in claim 1, wherein the size of said peripheral basin frame can be adjusted by a distance between two said adjacent connection frames, and also can be determined by the amount number of said connection frames.

16. The electromagnetic vibration device, as recited in claim 1, wherein the size of said peripheral basin frame is the same as the size of said vibration plate device.

17. A manufacturing method of the electromagnetic vibration device comprising the steps of:

(a) opening one mold for metal connection frames, which are forming by die casting and stamping;

(b) opening one mold for connection blocks, which is forming by plastic injecting;

(c) assembling four groups of said metal connection frames by said plastic connection blocks to form an upper peripheral basin frame (which can also form an integral peripheral basin frame);

(d) connecting said peripheral basin frame to a speaker via a plurality of mounting holes to form an upper basin frame of said speaker;

(e) putting an upper suspension and a vibration plate into a molding base, which can be process by the injection method to from a vibration plate with said upper suspension;

(f) adhering a lower suspension and a lower surface of the vibration plate with said upper suspension, as mentioned in step (e), together, and further adhering with said upper peripheral basin frame, as mentioned in step (c), to form a vibration plate device, (g) putting an U-yoke, a magnet, and a pole piece into a plastic injection mold, so as to form a lower peripheral basin frame with a magnetic loop system;

(h) connecting a voice coil and said vibration plate by a supporting disk:

(i) connecting said vibration plate device, as mentioned in step (f), and said lower peripheral basin frame with said magnetic loop system, as mentioned in step (g), by screws, melding, and locking so as to form an integral electromagnetic vibration device (a speaker, especially to a bass and large diameter speaker).

18. The manufacturing method of the electromagnetic vibration device, as recited in claim 17, in step (f), each two said vibration plate can be locked together, in such manner that one of said vibration plates is rotated 180 degrees and then the other said vibration plate is connected with such said one vibration plate by locking or gluing, so as to form said vibration plate device.

* * * * *